United States Patent [19]

Nash et al.

[11] Patent Number: 4,713,644

[45] Date of Patent: Dec. 15, 1987

[54] VACUUM FUSE

[75] Inventors: William H. Nash, South Milwaukee; Eugene C. Fowler, Milwaukee, both of Wis.

[73] Assignee: Cooper Industries, Inc., Houston, Tex.

[21] Appl. No.: 918,238

[22] Filed: Oct. 14, 1986

[51] Int. Cl.[4] ..... H01H 85/04

[52] U.S. Cl. ..... 337/158; 200/144 B

[58] Field of Search ..... 337/158; 200/144 B; 337/34

[56] References Cited

U.S. PATENT DOCUMENTS 3,913,047 10/1975 Arthur et al. ..... 337/34

4,414,448 11/1983 Kashimoto et al. ..... 200/144 B

*Primary Examiner*—Harold Broome

*Attorney, Agent, or Firm*—Eddie E. Scott; Nelson A. Blish; Alan R. Thiele

[57] ABSTRACT

A vacuum fuse (10) including a pair of arcing electrodes in the form of parallel, confronting, spaced apart disks (13, 14) supported on the inner ends of aligned contact rods (11, 12). The confronting surfaces of the electrodes define an arc gap (18) and are provided with a plurality of arcuate slots (54). A fusible element (19) projects from bores (23, 24) which are recessed relative to the confronting disk surfaces to bridge the arc gap and it and the arcing electrodes (13, 14) are electrically connected to the contact rods (11, 12). The fusible element (19) is flattened at the mid-point of the arc gap and a hole (22) is drilled in the flattened section. The outer housing (1) of the fuse (10) includes a metallic housing member (7) and ceramic end plates (4, 6). Use of a metallic housing (7) eliminates the need for a separate, axial, metallic shield to prevent deposition of vaporized metallic particles during current interruption. The electrical and structural connections are brazed with a vacuum being pulled on the fuse interior during the brazing operation. All structural elements are arranged with the longitudinal axis of the final assembly as the reference point.

7 Claims, 2 Drawing Figures

VACUUM FUSE

BACKGROUND OF THE INVENTION

Field of the Invention

This invention relates to vacuum fuses.

Background

Electrical installations such as underground distribution systems have grown in popularity and also in size and complexity. With this growth has come an increased demand for sectionalizing equipment. Current limiting fuses, oil fuse cutouts, fused load interrupters and the like have been used but such equipment suffers from various drawbacks such as cost and limited current carrying and interrupting capacity.

A vacuum fuse disclosed in U.S. Pat. No. 3,913,047 and assigned to the same corporation as the present invention was a partial solution to some of the above problems. However, the 3,913,047 patent was evolutionary in nature and has some design problems common to vacuum fuses. For example, vacuum fuses usually incorporate a separate metal shield surrounding the arcing electrodes in addition to the housing member. This is an extra element that must be included at additional costs. It also complicates the manufacturing process because an additional step is required to insert the shield.

An additional problem with prior art vacuum fuses is that the contact rod for the arcing electrodes extends beyond the end caps. This makes for a large, awkward vacuum fuse and results in unnecessary constraints on locations suitable for installation of the fuse. Also the protruding contact rods use more material than is necessary for their function which adds to the manufacturing costs.

This invention is concerned with these problems and proposes a vacuum fuse construction which is well suited to use in electrical installations described above.

SUMMARY OF THE INVENTION

In accordance with this invention, a pair of spaced, confronting arcing surfaces are enclosed within a sealed housing. The space between the arcing surfaces is bridged by a fusible element which is electrically connected to spaced contact rods which rods are also electrically connected to the arcing surfaces. The sealed housing is made of a metal tube with ceramic end plates surrounding a central section to define an area in which the arcing surfaces are located. The interior space defined by the housing is evacuated by placing the finished assembly in a vacuum chamber prior to the brazing step. Brazing is completed in the vacuum chamber to seal in the vacuum. A getter is incorporated in the vacuum fuse to react with and remove any gases inadvertently trapped in the fuse.

In accordance with more specific aspects of this invention, the fusible element extends from areas which are recessed relative to the arcing surfaces to insure that the arc which is drawn when the fusible element melts will transfer to the arcing surfaces and also to maintain desired melting characteristics; the arcing surfaces are defined by electrically conductive disks which provide heat sink masses for the arc; arcuate slots are provided in the confronting arcing surfaces to influence outward travel of the arc; and the fusible element, at a location generally in the center of the space between the arcing surfaces, is provided with a reduced cross section to determine the $i^2t$ characteristics and the point of arc initiation.

Additionally, it is preferred that the component elements of the vacuum fuse be arranged relative to the longitudinal axis of the fuse. Specifically, the contact rods are arranged end-to-end on the axis, the arcing surfaces, or disks, are centered on the axis, the fusible element and, where provided, the recesses are on the axis, and the metallic housing member and the ceramic end plates are concentrically arranged on the axis. This permits the entire assembly to be held in a jig for ease of assembly and it can then be held assembled during the evacuation and brazing operation.

Other objects and advantages will be pointed out in, or be apparent from, the specification and claims, as will obvious modifications of the embodiment shown in the drawings, in which:

DESCRIPTION OF THE PREFERRED EMBODIMENT

Figure 1:
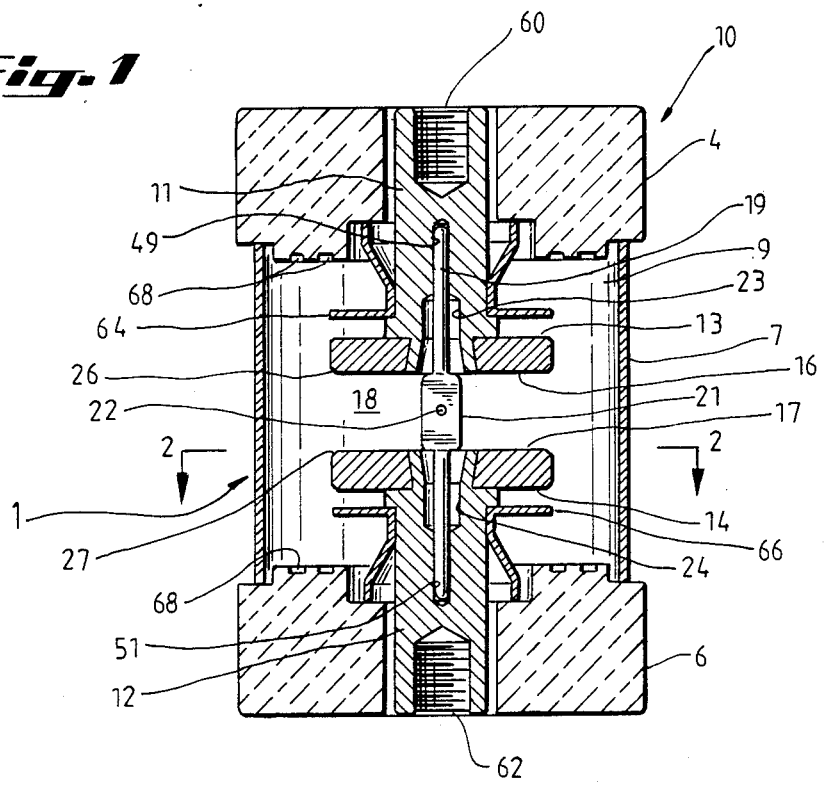
FIG. 1 is an axial section through a vacuum fuse.
Figure 2:
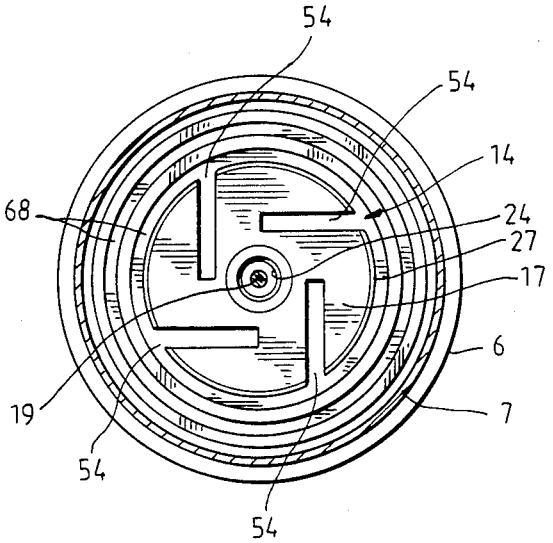
FIG. 2 is a section taken generally along line 2—2 in FIG. 1.

The vacuum fuse 10 depicted in the drawings includes a housing 1 made up of end plates or end caps 4 and 6, and cylindrical housing member 7. The end plates are made of suitable electrical insulating material such as high alumina, forsterite, other ceramic materials, glass, or glass-ceramic. The housing member may be made of suitable metallic material such as copper-nickel, iron-nickel, cobalt or stainless steel, which materials should also be compatible with the end plate material so that the insulators are joinable to the end caps.

This housing structure defines an interior area 9. The fuse elements housed within this area include elongated contact rods 11 and 12 and arcing electrodes or disks 13 and 14 supported on the inner ends of the contact rods. The arcing electrodes are generally disk-shaped and are arranged parallel to each other to define confronting arcing surfaces 16 and 17 between which gap 18 is defined. Fuse element 19 is electrically connected to the contact rods 11 and 12, as are disks 13 and 14, and the fuse element extends between the rods bridging gap 18. Fuse element 19 is preferably in the form of an OFHC (oxygen free high conductivity) copper wire of appropriate diameter and is provided with a flattened section 21 which is located between arcing surfaces 16 and 17. Hole 22 is drilled in the flattened section and is located at the center of the gap 18 relative to arcing surfaces 16 and 17. This combination of flattened section and hole 22 provides a reduced cross section area in the gap to permit precise definition of the melting $i^2t$ characteristics of the fuse and, furthermore, insures initiation of arcing in the center of gap 18. Other wire configurations are possible to provide the desired minimum cross section area in the center of gap 18. The diameter of the fuse element is selected to provide the particular desired ampere rating. For example, a number 11 copper wire will produce a 200 ampere rating.

Contact rods 11 and 12 and disks 13 and 14 can be made from OFHC or other de-oxidized copper.

Preferably, the fuse element is supported in and extends from areas which are recessed with respect to arcing surfaces 16 and 17. In the preferred embodiment these recesses are provided by drilled bores 23 and 24 in the adjacent ends of contact rods 11 and 12. The reasons for the desirability of supporting the fuse element in these recessed areas are that, when the fuse is called upon to operate the fuse element must melt, by recessing the point of support for the fuse element the heat sink effect of disks 13 and 14 (which after the arc is drawn is a desirable feature) is minimized resulting in maximum heat retention in the fusible element and thus a shorter melting time; secondly, with the recess, as the fuse element melts back to points approximately flush with the arcing surfaces 16 and 17, the arc drawn will transfer immediately to the arcing surfaces for proper arc extinction as will be evident from the discussion hereinafter; and support of the fuse element in the recessed eliminates the possibility of residual fuse element portions protruding into the gap which would make the fuse more prone to restrike or reignite at less than fault conditions.

Upon melting, the fuse element burns back to a point flush with arcing surfaces 16 and 17 at which point the arc will transfer to the arcing surfaces and, in accordance with well known phenomena, will move outwardly on the arcing surfaces toward the periphery of disks 13 and 14. Disks 13 and 14 are beveled adjacent their periphery at areas 26 and 27, this increases the length of the arc as it approaches the periphery of the disks and enhances extinction of the arc when current zero condition occurs.

As will be described more completely hereinafter, a vacuum condition is created in area 9 to achieve the desired fuse operation. During interruption, products of arcing are expelled outwardly from between disks 13 and 14. In prior art vacuum fuses, a metal shield in the form of a cylindrical ring was inserted to protect the joint between insulating, two part housing members from damage from products produced by the arc. This shield was made of an OFHC copper or stainless steel. This shield added significant additional costs to each fuse. Since it was a separate additional part, it also required one additional assembly step. In the present invention, housing member 7 is made of suitable metallic material and is capable of withstanding damage from arc products. Thus, a separate shield is unnecessary.

End plates 4 and 6 provide insulation between contact rods 11 and 12 and housing member 7. During the period of time when an arc is generated, metallic material may be generated. Vapor shields 64 and 66 are provided to prevent deposition of products generated during current interruption on the ceramic end plates 4 and 6 limiting their ability to properly insulate housing 7 from contact rods 11 and 12. Vapor shields 64 and 66 are commonly made of metallic material.

The ceramic surfaces of end caps 4 and 6 are provided with grooves 68. Grooved surface 68 provides increased tracking resistance.

To complete the description of the general structure of the fuse, it will be noted that contact rods 11 and 12 have threaded inserts 60 and 62 which provide the media through which electrical connection of the fuse can be made in the particular circuit to be protected. Various forms of conventional mounting of the fuse can be utilized and are not shown, for example a clip-style mounting or the like can be used.

Looking now more specifically to the preferred structure of the fuse as illustrated in the drawings, the overall fuse is elongated and has a longitudinal axis which coincides generally with the center or axis of contact rods 11 and 12. The various structural elements of the fuse are formed and assembled using that longitudinal axis as a reference point. The contact rods are arranged end-to-end on that axis, the disks 13 and 14 and arcing surfaces 16 and 17, which the disks cooperate in defining, are centered on that axis, and fuse element 19 is also located on the axis as are bores 23 and 24. With reference to the outer housing 7, it is generally cylindrical and concentrically arranged on the longitudinal axis.

With the just described structural arrangement of the elements, it is then possible to assembly all of the elements in their final orientation in a suitable jig. Being jig assembled, the elements can then be held together for a brazing operation. Prior to the brazing operation, brazing compound is provided at the connections of the end plates with the contact rods and the housing member. The jig assembled parts with the applied brazing compound is then introduced into a suitable evacuation chamber. A vacuum is drawn and maintained for a suitable period of time. The temperature is then raised to about 840° C. for brazing. The use of brazed connections provides a very reliable seal at the various connection points. Relatively high vacuums of from $10^{-6}$ to $10^{-9}$ torr can be achieved in the fuse and, as importantly, because of the positively sealed structure of the fuse and its structural integrity, the integrity of the vacuum can be maintained over a relatively long service life.

In this respect, it should be noted at this point that the metallic-ceramic housing construction provides a housing which will withstand the high brazing or bake-out temperatures and also insures structural integrity in service.

A further refinement is found in the manner in which fuse element 19 is supported. The fuse element extends into drilled, axial openings 49 and 51 in contact rods 11 and 12.

Slots 54 can be provided in disks 13 and 14, the slots taking the form of openings through the thickness of the disks and being generally arcuate in configuration. The arcuate slots influence arc travel from the point of the initial arc outwardly toward the periphery of the disks.

With this fuse construction, vacuum fuses having current ratings from 150 to 300 amps for 15-kv systems can be provided, higher ampere and voltage ratings can be achieved as can fuses having even lower ratings. The vacuum fuse is mass producible and insures vacuum integrity over a relatively long service life. It should be remembered that the fuse may be in service for a number of years before it is called upon to interrupt and thus the vacuum must be maintained for long periods and the described construction provides that vacuum integrity. An effective compromise is achieved between minimum interior area to insure an effective vacuum while still maintaining adequate space for arc extinction as well as relatively long arc runner surfaces (disks 13 and 14). This also permits relatively large disks to be used to provide heat sinks to absorb the energy which is created during arcing and for arc extinction.

Although but one embodiment of the present invention has been illustrated and described, it will be apparent to those skilled in the art that various changes and modifications may be made therein without departing from the spirit of the invention or from the scope of the appended claims.

We claim:

1. A vacuum fuse comprising, means defining first and second spaced, generally parallel, confronting arcing surfaces arranged in general registry with each other, fusible element means connected to and bridging the space between said arcing surfaces, first and second electrically conductive contact rods electrically connected to said fusible element means and said arcing surfaces and projecting oppositely relative to the space between said arcing surfaces, a metallic, generally cylindrical housing member enclosing the space between said arcing surfaces, end plates of an insulating material axially aligned with and capping said housing member, said contact rods terminating substantially flush with said end plate, and means providing a seal connection between said housing member, and said end plates and between end plates and said contact rods so that the interior of said housing in which said arcing surfaces are arranged is sealed, said interior being open between said housing and arcing surfaces.

2. The vacuum fuse of claim 1 including means defining opposed recesses in said confronting surfaces, and wherein said fusible element means is connected in said recesses.

3. The vacuum fuse of claim 1 wherein said means defining said arcing surfaces includes first and second spaced, electrically conductive disks.

4. The vacuum fuse of claim 1 wherein said end plates are grooved.

5. The vacuum fuse of claim 1 including means defining a plurality of generally arcuate slots in each of said arcing surfaces.

6. The vacuum fuse of claim 1 wherein said fusible element means is an elongated member having a reduced cross section area therein located centrally relative to said space between said arcing surfaces.

7. The vacuum fuse of claim 1 wherein said end plates are comprised of ceramic.

* * * * *